United States Patent [19]

Thomsen

[11] Patent Number: 5,049,078

[45] Date of Patent: Sep. 17, 1991

[54] PICTURE BOOK WITH PLAY EFFECT

[75] Inventor: Erik D. Thomsen, Kolding, Denmark

[73] Assignee: Interlego A.G., Baar, Switzerland

[21] Appl. No.: 434,555

[22] Filed: Nov. 8, 1989

Related U.S. Application Data

[63] Continuation of Ser. No. 163,975, filed as PCT DK87/00094 on Jul. 17, 1987, published as WO88/00492 on Jan. 28, 1988, abandoned.

[30] Foreign Application Priority Data

Jul. 18, 1986 [DK] Denmark ..... 3425/86

[51] Int. Cl.[5] ..... G09B 17/00

[52] U.S. Cl. ..... 434/178; 434/403; 446/147

[58] Field of Search ..... 434/178, 403, 429; 446/147, 148; 40/538

[56] References Cited

U.S. PATENT DOCUMENTS

| | | | |
|---|---|---|---|
| 1,405,134 | 1/1922 | Hoyme | 434/178 |
| 1,414,849 | 5/1922 | Williams | 434/222 |
| 2,768,452 | 10/1956 | Littlejohn . | |
| 2,946,137 | 7/1960 | Worth . | |
| 3,316,669 | 5/1967 | Nachbar | 434/429 |
| 3,451,882 | 6/1969 | Propoggio | 40/538 |
| 3,918,180 | 11/1975 | Chamberlin | 434/178 |
| 4,176,473 | 12/1979 | Rae | 434/429 |
| 4,702,700 | 10/1987 | Taylor | 434/429 |

FOREIGN PATENT DOCUMENTS

| | | |
|---|---|---|
| 1924206 | 11/1970 | Denmark . |
| 2450332 | 4/1975 | Denmark . |
| 0152680 | 8/1985 | European Pat. Off. . |
| 0186930 | 7/1986 | European Pat. Off. . |
| 1478442 | of 1969 | Fed. Rep. of Germany . |
| 1019109 | 2/1966 | United Kingdom . |

*Primary Examiner*—Edward M. Coven
*Assistant Examiner*—Valerie Szczepanik
*Attorney, Agent, or Firm*—Kane, Dalsimer, Sullivan, Kurucz, Levy, Eisele and Richard

[57] ABSTRACT

A picture book set with play effect, having a plurality of toy elements with modularly dimensioned coupling means. The toy elements may be placed on a picture plane provided with correspondingly dimensioned positioning recesses or elevations, so that a child may play with the toy elements to arrange a three-dimensional representation of the situation described in the story text.

4 Claims, 3 Drawing Sheets

Fig. 1
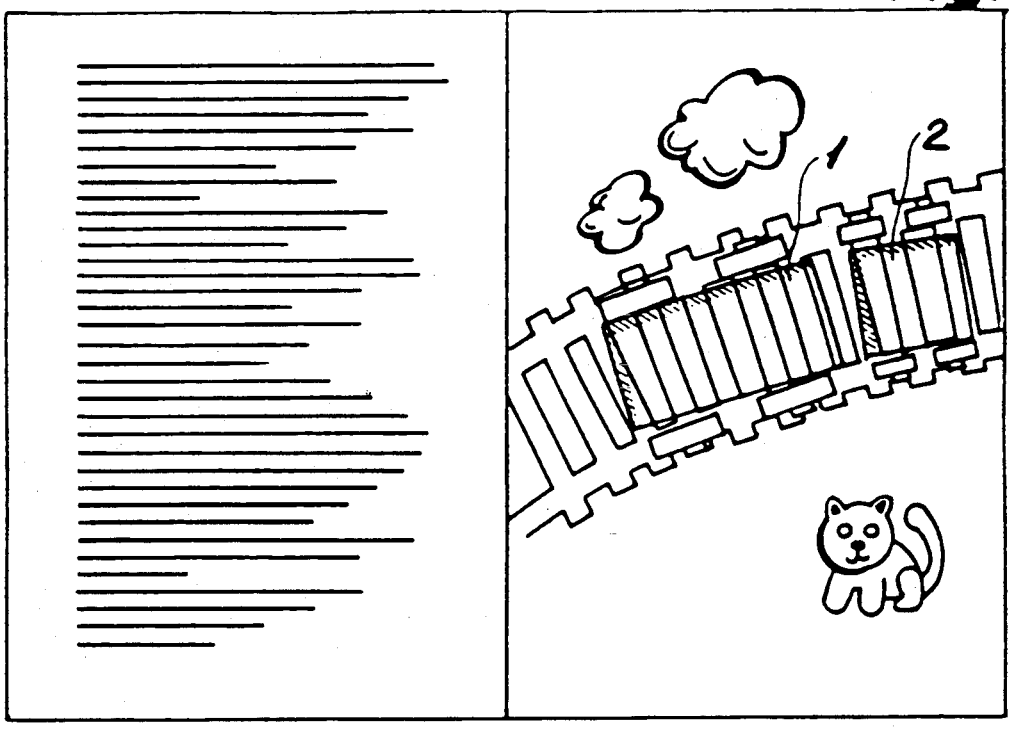
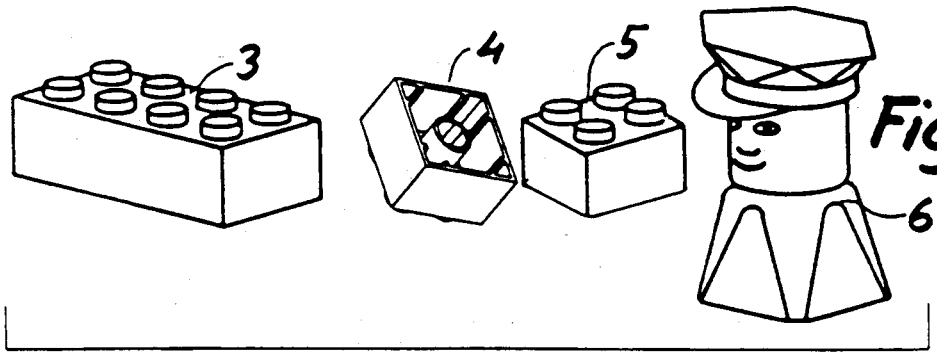
Fig. 2

PICTURE BOOK WITH PLAY EFFECT

This is a continuation of co-pending application Ser. No. 163,975 filed as PCT DK87/00094 on Jul. 17, 1987, published as WO88/00492 on Jan. 28, 1988, now abandoned.

The invention concerns a picture book with play effect comprising means for positioning an object on a picture plane so that, in connection with the reading, a child is induced to place the spatial figures on the picture plane.

Books with play effect are known from the German Offenlegungsschriften 1 924 206 and 2 450 332. Furthermore, books are known where pockets and associated cardboard figures are designed to induce the child to participate actively in the use of the books.

The object of the invention is to provide a picture book of the above-mentioned type which, by a special arrangement of the book and the objects, involves an improved educational effect through direct interplay between book and toy.

This object is achieved in that the objects comprise interconnectible toy elements, and that the book has positioning means for cooperation with these toy elements. When the book is used, the child will be induced at various passages in the text to place the spatial figures at specific places in the picture plane. The picture resulting from each positioning affects the course of the text so that the child's overall experience occurs through motory, auditively and visually perceptual activity. It is also essential that the child itself is free to go beyond the text and carry on a building activity since the toy elements are interconnectible.

The positioning means in the picture plane may be recesses and/or elevations, and several layers of toy elements may be built together, the lower layer being positioned in accordance with the modular dimensions of the toy elements.

Thus, the invention generally concerns the use of interconnectible toy elements. In an embodiment of the picture book, a left side may contain text, while the associated right side is provided with pictures and the positioning means, but it will be appreciated that the picture planes may be present separately, while the associated story text may be provided in a separate book, on tape, etc.

BRIEF DESCRIPTION OF THE DRAWINGS

The invention will be explained more fully by the following description of a preferred embodiment with reference to the drawings, in which FIG. 1 shows an opened book for use in connection with the invention, FIG. 2 shows some interconnectible toy elements for use in connection with the invention, FIG. 4 shows another example of a book, while

DESCRIPTION OF THE PREFERRED EMBODIMENTS

Figure 3:
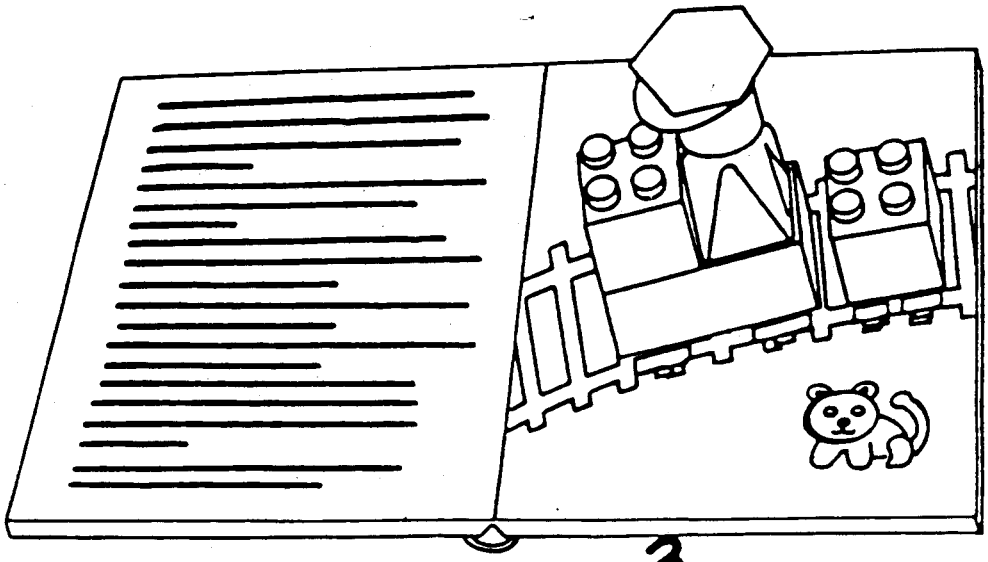
FIG. 3 shows an embodiment of the picture book according to the invention where the toy elements are positioned in the picture plane.

The book shown in FIG. 1 comprises a left side with a story text and a right side with a picture plane. As appears from the figure, the picture plane shows some clouds, a cat and a railway track. According to the invention each toy element comprises a block having at least one stud and socket defining a coupling means of a modular dimension, as shown in FIG. 2. The picture plane comprises some positioning means which, in the embodiment shown, are shaped as recesses (or elevations) 1 and 2 (the hatched areas) whose dimensions are an integral multiple of the modular dimension of the building blocks' coupling means. The building block 3 fits in the recess 1, while the two blocks 4 and 5 as well as the FIG. 6 fit in the recess 2. With reference to the text shown at the left side, the child will be induced during reading to place the said blocks in the manner appearing in FIG. 3.

To assist the child additionally, the hatched areas may be colored in accordance with the color of the block to be placed in the area.

Figure 4:
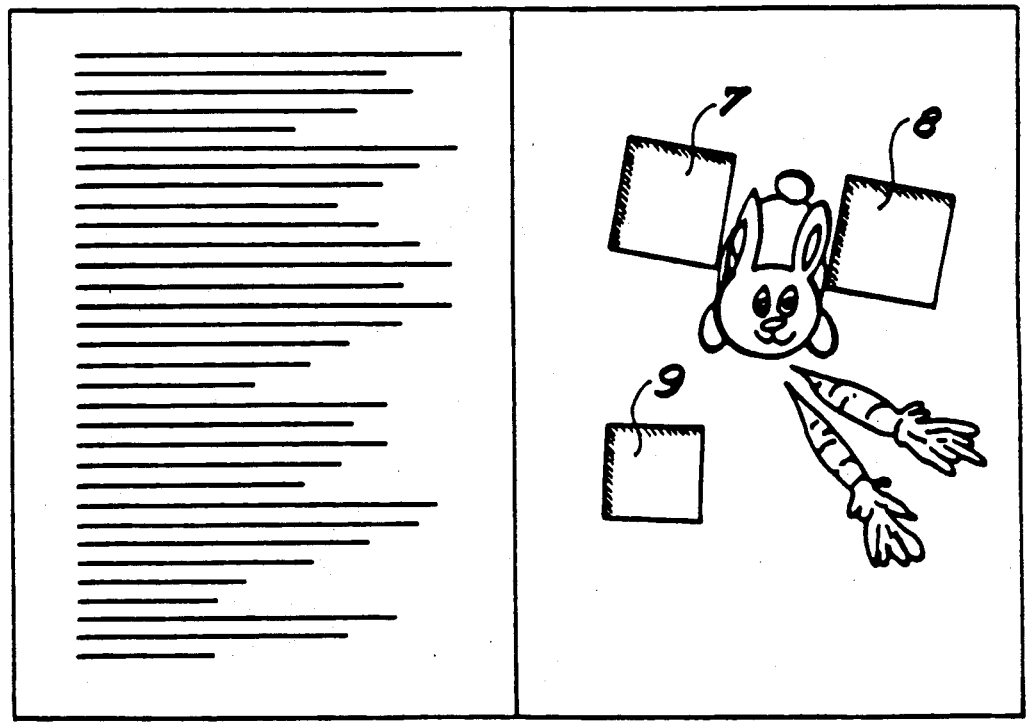
Figure 5:
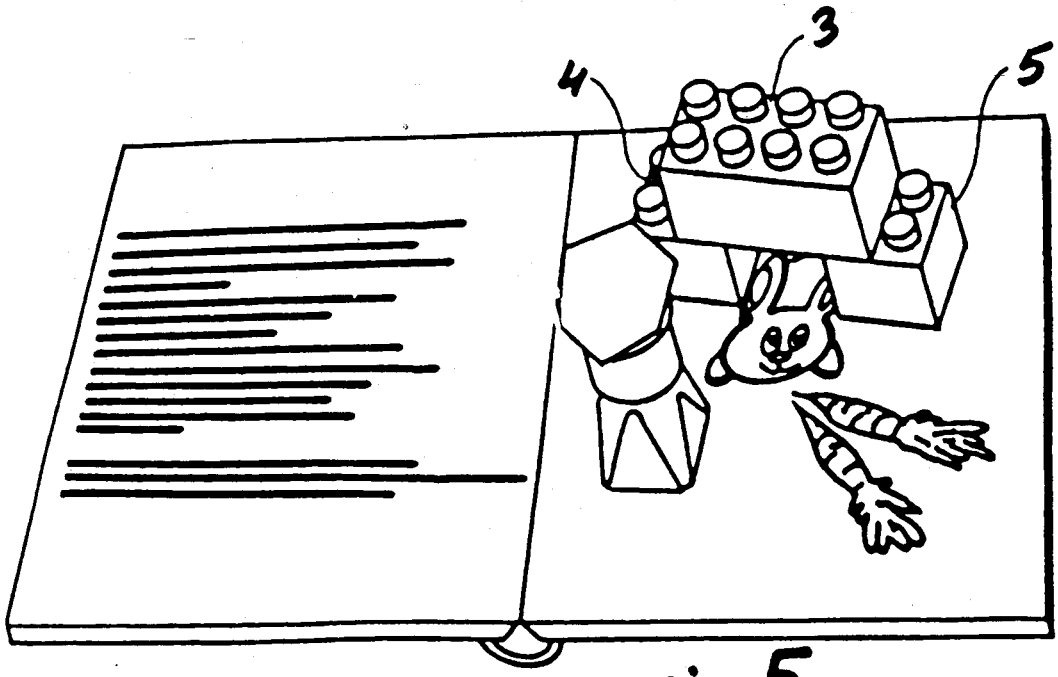
FIG. 5 is a perspective view of the book of FIG. 4, with the toy elements positioned correctly.

FIG. 4 shows another example of a story text and associated picture plane with depressions 7, 8 and 9. In this embodiment, the depressions 7 and 8 are placed spaced apart by an integral multiple of the modular dimensions of the building elements. Then, as shown in FIG. 5, the big block 3 may be placed on top of the small blocks 4 and 5 and be interconnected with these in accordance with the modular dimension of the coupling means.

For the sake of clarity, more complicated examples are not shown, but it will be appreciated that the picture plane may be more complicated and contain a larger number of positioning means to provide a greater degree of difficulty. At the same time, it will be possible to put a larger number of building blocks together in more combinations.

I claim:

1. A picture book set with play effect comprising:

a book having at least one page containing at least one picture thereon;

a plurality of toy elements, each having at least one stud and socket thereon defining a coupling means of a modular dimension and interconnectable with each other via said coupling means, the dimensions of each of said toy elements being an integral multiple of said modular dimension of said coupling means; and, positioning means on said page arranged within said picture for coupling at least one of said toy elements to said page to receive others of said toy elements, said positioning means having dimensions comprising integral multiples of said modular dimension of said coupling means.

2. A picture book set according to claim 6, wherein the positioning means comprise recesses in the picture plane.

3. A picture book set according to claim 6, wherein the positioning means comprise elevations on the picture plane.

4. A picture book set according to claims 2 or 3 wherein the picture includes multiple positioning means thereon and the distances between the positioning means comprise a multiple of a modular dimension of the toy interconnectable elements.

* * * * *